US007644515B2

(12) United States Patent
Doh

(10) Patent No.: US 7,644,515 B2
(45) Date of Patent: Jan. 12, 2010

(54) LINT FILTER ASSEMBLY OF LAUNDRY DRYER

(75) Inventor: Young Jin Doh, Busan-si (KR)

(73) Assignee: LG Electronics Inc., Seoul (KR)

( * ) Notice: Subject to any disclaimer, the term of this patent is extended or adjusted under 35 U.S.C. 154(b) by 190 days.

(21) Appl. No.: 10/568,220

(22) PCT Filed: May 25, 2005

(86) PCT No.: PCT/KR2005/001543

§ 371 (c)(1),
(2), (4) Date: Feb. 14, 2006

(87) PCT Pub. No.: WO2005/121437

PCT Pub. Date: Dec. 22, 2005

(65) Prior Publication Data

US 2008/0271336 A1 Nov. 6, 2008

(30) Foreign Application Priority Data

Jun. 5, 2004 (KR) ..... 10-2004-0041114

(51) Int. Cl.
*F26B 11/02* (2006.01)

(52) U.S. Cl. ..... 34/603; 68/5 C

(58) Field of Classification Search ..... 34/595, 34/596, 602, 603, 606, 609, 620; 68/5 C
See application file for complete search history.

(56) References Cited

U.S. PATENT DOCUMENTS 2,310,680 A * 2/1943 Dinley ..... 34/74
2,460,422 A * 2/1949 Koppel ..... 34/606
2,521,712 A * 9/1950 Geldhof ..... 34/82
2,648,142 A * 8/1953 Shapter ..... 34/82
2,722,750 A * 11/1955 Smith et al. ..... 34/82
2,722,751 A * 11/1955 Steward ..... 34/82
2,764,820 A * 10/1956 Kauffman, II ..... 34/79
2,798,304 A * 7/1957 Reiter ..... 34/91
2,798,306 A * 7/1957 Reiter ..... 34/609
2,798,307 A * 7/1957 Reiter ..... 34/610
2,809,442 A * 10/1957 Glasby, Jr. ..... 34/82
2,813,354 A * 11/1957 Buck ..... 34/91
2,814,130 A * 11/1957 Cayot ..... 34/82
2,827,783 A * 3/1958 Handley ..... 68/12.15
2,873,539 A * 2/1959 Morey ..... 34/597
2,875,996 A * 3/1959 Hullar ..... 432/67
2,884,710 A * 5/1959 Smith ..... 34/601
2,886,901 A * 5/1959 Whyte et al. ..... 34/601
2,931,687 A * 4/1960 Mitter ..... 312/323

(Continued)

FOREIGN PATENT DOCUMENTS

EP 0106289 4/1984

(Continued)

*Primary Examiner*—Stephen M. Gravini
(74) *Attorney, Agent, or Firm*—McKenna Long & Aldridge LLP

(57) ABSTRACT

A lint filter assembly for a laundry dryer is provided. In the lint filter assembly, a door is provided, a lint filter has a filter housing installed at the rear of the door and a filter main body inserted into the filter housing, and at least one securing member is provided to secure the filter main body to the filter housing.

9 Claims, 2 Drawing Sheets

U.S. PATENT DOCUMENTS 2,958,140 A * 11/1960 Smith ..... 34/598
2,961,776 A * 11/1960 Hughes ..... 34/607
2,964,851 A * 12/1960 Stelljes et al. ..... 34/82
2,983,050 A * 5/1961 Alaback ..... 34/90
2,991,990 A * 7/1961 Mitter ..... 432/107
3,000,108 A * 9/1961 Jones et al. ..... 34/607
3,102,008 A * 8/1963 Pansing et al. ..... 34/79
3,190,011 A * 6/1965 Shields ..... 34/77
3,263,343 A * 8/1966 Loos ..... 34/82
3,304,624 A * 2/1967 Czech ..... 34/82
3,320,678 A * 5/1967 Berke ..... 34/82
3,331,141 A * 7/1967 Jacobs et al. ..... 34/599
3,398,465 A * 8/1968 Miller et al. ..... 34/599
3,409,997 A * 11/1968 Krolzick et al. ..... 34/601
3,475,831 A * 11/1969 Workman ..... 34/82
3,555,701 A * 1/1971 Hubbard ..... 34/602
3,579,851 A * 5/1971 Elmy ..... 34/82
3,584,394 A * 6/1971 Grabek ..... 34/599
3,648,381 A * 3/1972 Fox ..... 34/82
3,718,982 A * 3/1973 Deaton ..... 34/82
3,789,514 A * 2/1974 Faust et al. ..... 34/82
3,892,048 A * 7/1975 Jacobsen, Jr. ..... 34/604
3,959,891 A * 6/1976 Burkall ..... 34/82
4,033,047 A * 7/1977 Kawai ..... 34/82
4,103,433 A * 8/1978 Taylor ..... 34/86
4,360,977 A * 11/1982 Frohbieter ..... 34/86
4,550,509 A * 11/1985 Murase ..... 34/604
4,557,058 A * 12/1985 Ozawa et al. ..... 34/82
4,653,200 A * 3/1987 Werner ..... 34/82
4,689,896 A * 9/1987 Narang ..... 34/82
4,700,495 A * 10/1987 Drews et al. ..... 34/603
4,720,925 A * 1/1988 Czech et al. ..... 34/82
4,817,297 A 4/1989 Toma et al.
4,854,054 A * 8/1989 Johnson ..... 34/603
4,891,892 A * 1/1990 Narang ..... 34/86
5,062,219 A * 11/1991 Harris et al. ..... 34/606
5,113,562 A * 5/1992 Studt ..... 29/401.1
5,117,563 A * 6/1992 Castonguay ..... 34/86
5,127,169 A * 7/1992 Ellingson ..... 34/601
5,136,792 A * 8/1992 Janecke ..... 34/78
5,279,047 A * 1/1994 Janecke ..... 34/78
5,388,344 A * 2/1995 Wallach ..... 34/91
5,459,945 A * 10/1995 Shulenberger ..... 34/605
5,701,684 A * 12/1997 Johnson ..... 34/595
5,706,588 A * 1/1998 Dausch et al. ..... 34/327
5,860,224 A * 1/1999 Larson ..... 34/418
6,067,723 A * 5/2000 Lafrenz ..... 34/61
6,237,373 B1 * 5/2001 Harris et al. ..... 68/18 F
6,385,862 B1 * 5/2002 Vande Haar ..... 34/441
6,698,107 B2 * 3/2004 Song et al. ..... 34/595
6,829,845 B2 * 12/2004 Han et al. ..... 34/603
6,874,248 B2 * 4/2005 Hong et al. ..... 34/239
6,915,593 B2 * 7/2005 Gruble et al. ..... 34/600
6,935,048 B2 * 8/2005 Park et al. ..... 34/132
6,966,126 B2 * 11/2005 Baurmann ..... 34/606
6,968,632 B2 * 11/2005 Guinibert et al. ..... 34/602
7,007,409 B2 * 3/2006 Moschutz et al. ..... 34/602
7,024,802 B2 * 4/2006 Myung ..... 34/604
7,036,243 B2 * 5/2006 Doh et al. ..... 34/595
7,055,262 B2 * 6/2006 Goldberg et al. ..... 34/86
7,065,904 B2 * 6/2006 Lee et al. ..... 34/601
7,065,905 B2 * 6/2006 Guinibert et al. ..... 34/603
7,093,377 B2 * 8/2006 Doh et al. ..... 34/596
7,121,018 B2 * 10/2006 Lee ..... 34/595
7,194,823 B2 * 3/2007 Nakamoto et al. ..... 34/526
7,225,562 B2 * 6/2007 Guinibert et al. ..... 34/601
7,251,905 B2 * 8/2007 Doh et al. ..... 34/603
7,257,905 B2 * 8/2007 Guinibert et al. ..... 34/82
7,325,332 B2 * 2/2008 Chung et al. ..... 34/602
7,406,780 B2 * 8/2008 Doh et al. ..... 34/606
7,458,171 B1 * 12/2008 Lentz ..... 34/75
7,467,483 B2 * 12/2008 Guinibert et al. ..... 34/601
7,523,564 B2 * 4/2009 Doh ..... 34/601
7,559,156 B2 * 7/2009 Renzo ..... 34/595
7,562,467 B2 * 7/2009 Doh ..... 34/601
2002/0108268 A1 * 8/2002 Helmer ..... 34/600
2003/0014880 A1 * 1/2003 Baurmann ..... 34/595
2004/0118011 A1 * 6/2004 Moschutz et al. ..... 34/595
2004/0118012 A1 * 6/2004 Gruble et al. ..... 34/595
2004/0134092 A1 * 7/2004 Hong et al. ..... 34/595
2004/0163276 A1 * 8/2004 Han et al. ..... 34/603
2005/0076535 A1 * 4/2005 Guinibert et al. ..... 34/601
2005/0115104 A1 * 6/2005 Guinibert et al. ..... 34/601
2005/0120585 A1 * 6/2005 Lee et al. ..... 34/602
2005/0126035 A1 * 6/2005 Lee et al. ..... 34/602
2005/0132593 A1 * 6/2005 Doh et al. ..... 34/73
2005/0132594 A1 * 6/2005 Doh et al. ..... 34/73
2005/0132600 A1 * 6/2005 Myung ..... 34/601
2005/0132601 A1 * 6/2005 Doh ..... 34/601
2005/0132604 A1 * 6/2005 Hong et al. ..... 34/603
2005/0138831 A1 * 6/2005 Lee ..... 34/73
2005/0166421 A1 * 8/2005 Doh et al. ..... 34/603
2005/0268483 A1 * 12/2005 Park et al. ..... 34/603
2006/0096120 A1 * 5/2006 Moschutz et al. ..... 34/600
2006/0123652 A1 * 6/2006 Chung et al. ..... 34/92
2006/0196077 A1 * 9/2006 Choi ..... 34/602
2006/0236560 A1 * 10/2006 Doh et al. ..... 34/596
2006/0260150 A1 * 11/2006 Doh ..... 34/601
2006/0265899 A1 * 11/2006 Renzo ..... 34/603
2007/0006477 A1 * 1/2007 Guinibert et al. ..... 34/85
2007/0113419 A1 * 5/2007 Belgard ..... 34/82
2007/0163144 A1 * 7/2007 Dittmer et al. ..... 34/602
2007/0186440 A1 * 8/2007 Guinibert et al. ..... 34/603
2007/0220776 A1 * 9/2007 Guinibert et al. ..... 34/603
2008/0022552 A1 * 1/2008 Forget ..... 34/602
2008/0060218 A1 * 3/2008 Doh ..... 34/601
2008/0104862 A1 * 5/2008 Dittmar et al. ..... 34/601
2008/0141558 A1 * 6/2008 Bae et al. ..... 34/595
2008/0163510 A1 * 7/2008 Dittmar et al. ..... 34/108
2009/0071033 A1 * 3/2009 Ahn et al. ..... 34/595

FOREIGN PATENT DOCUMENTS

EP 0789105 8/1997
JP 03251297 A * 11/1991

* cited by examiner

[Fig. 1]
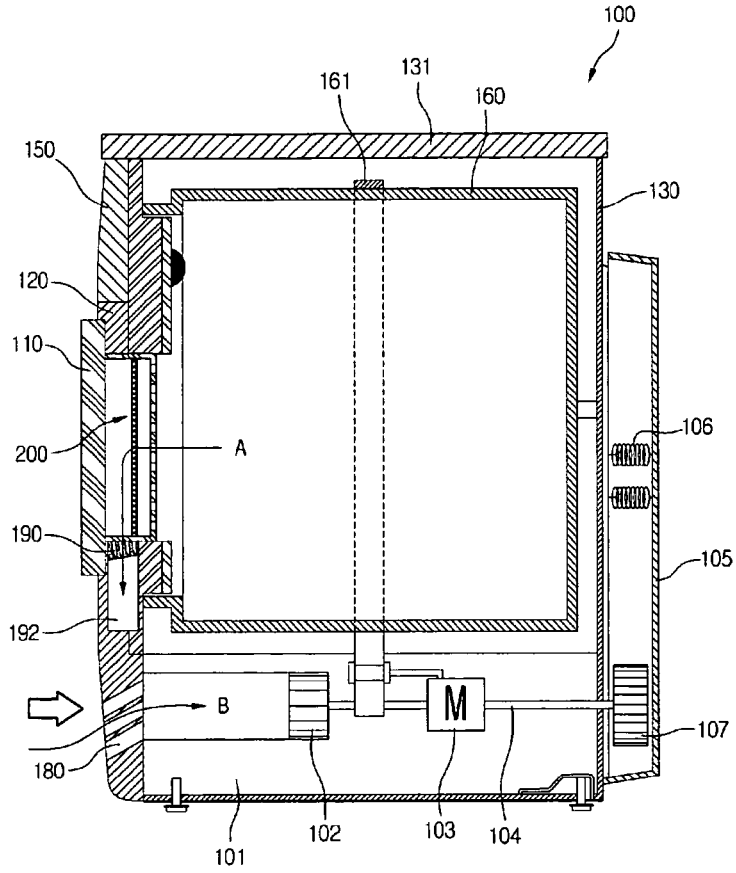
[Fig. 2]
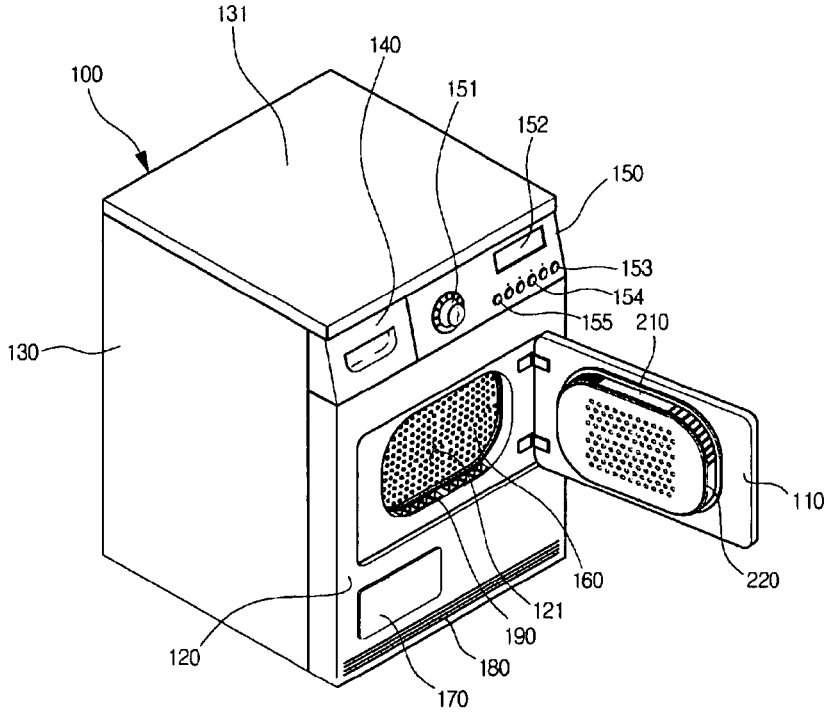

[Fig. 3]
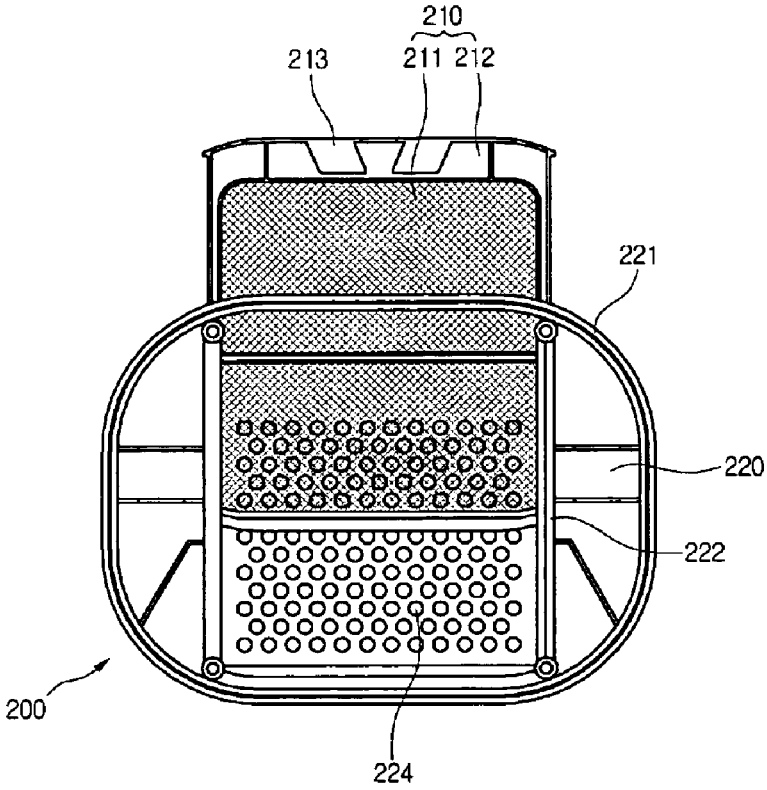
[Fig. 4]
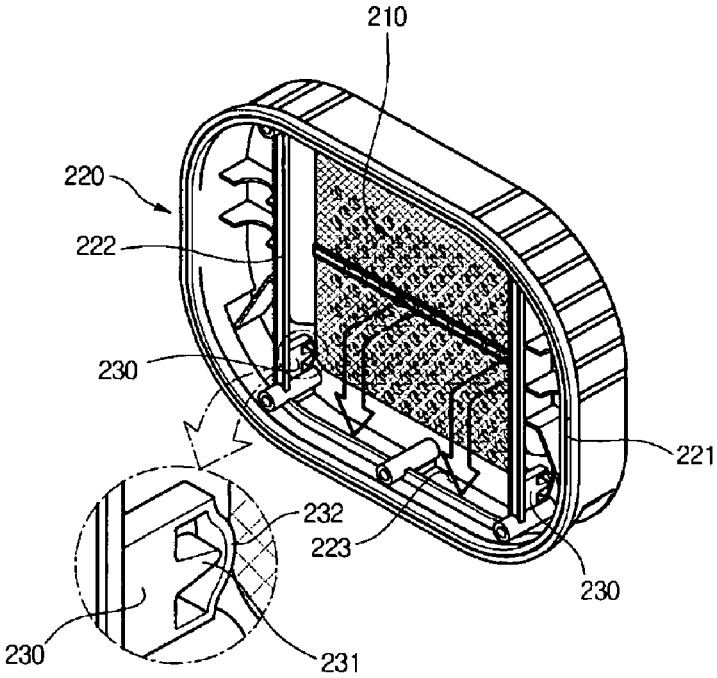

LINT FILTER ASSEMBLY OF LAUNDRY DRYER

This application claims the benefit of Korean Patent Application No. 2004-0041114, filed on Jun. 5, 2004 and PCT Application No. PCT/KR2005/001543, filed on May 25, 2005, which are hereby incorporated by reference for all purposes as if fully set forth herein.

TECHNICAL FIELD

The present invention relates to a laundry dryer, and more particularly, to a lint filter assembly of a laundry dryer having a door lint filter that is firmly held in its housing.

BACKGROUND ART

In general, laundry dryers are popular home appliances that hold wet laundry inside a drum, and dry the laundry by applying hot, dry air to the laundry.

In detail, a laundry dryer employs a motor-driven drum to tumble laundry placed therein, while blowing hot air through the drum to dry the laundry. Dryers are divided into two basic types: exhaust-type dryers that expel the hot air that has absorbed moisture from the laundry and condensing dryers that use condensers to condense the absorbed moisture from the hot air and then recirculate the hot air within the dryer.

The above laundry dryers have a door disposed at their front portions for providing access into the laundry drum, and a lint filter installed on the door.

Specifically, lint and foreign materials from the laundry is blown around in the drum during the drying process. When the hot air containing lint and other materials in the drum passes through the door filter, the lint and foreign materials are trapped by the filter. Such a lint filter installed in a door is usually held in a filter case.

Here, when installing the lint filter in the filter case, it is important that the peripheral edges of the filter are positioned firmly against the case in order to prevent lint from passing through the loose gaps and escaping out of the dryer. However, laundry dryers according to the prior art do not have structures that position their door filters firmly against their housings, and thus, a portion of the lint in their drums bypasses the filters and escapes out from the dryers.

Also, in the case of condensing dryers, lint that bypasses the lint filter circulates within the dryer, and accumulates on a fan or heater. When this occurs, lint can accumulate on a fan shaft, preventing the fan from rotating, or accumulate on a heater and be ignited by the heater to cause a fire.

DISCLOSURE OF INVENTION

Technical Problem

To solve these problems, the present invention provides an improved door lint filter assembly for a laundry dryer that effectively filters lint during a drying cycle.

Furthermore, the lint filter assembly of the present invention prevents unfiltered lint from amassing on a fan motor shaft to inhibit the operation of the motor or on a heater to be ignited by the heater to cause a fire.

Technical Solution

To achieve the above objects, there is provided a lint filter assembly for a laundry dryer including: a door; a lint filter having a filter housing installed at the rear of the door and a filter main body inserted into the filter housing; and at least one securing member for securing the filter main body to the filter housing.

According to another aspect of the present invention, there is provided a lint filter assembly for a laundry dryer including: a door; a filter main body having a mesh and a frame on the outer periphery of the wire mesh; and a filter housing disposed at the rear of the door, and having a guide rail for guiding an insertion of the filter main body and a pressing member protruding at a right angle to the guide rail.

ADVANTAGEOUS EFFECTS

An advantage of the lint filter assembly for a laundry dryer according to the present invention is that a lint filter is pressed more firmly against its filter case.

Also, because the lint filter is pressed firmly against its filter case, lint inside the drum does not bypass the lint filter. Thus, lint bypassing the filter and exiting the dryer is prevented.

Furthermore, the accumulation of lint that bypasses the filter, settling on a fan motor shaft or a heater to impede motor operation or to be ignited by the heater causing a fire, can be avoided.

BRIEF DESCRIPTION OF THE DRAWINGS

The spirit of the present invention can be understood more fully with reference to the accompanying drawings. In the drawings:

FIG. 1 is a sectional view of a condenser-type laundry dryer employing a lint filter assembly according to the present invention;

FIG. 2 is a perspective view of the condenser-type laundry dryer;

FIG. 3 is rear view of the door lint filter according to the present invention; and FIG. 4 is a frontal perspective view of the door lint filter according to the present invention.

BEST MODE FOR CARRYING OUT THE INVENTION

Hereinafter, preferred embodiments of a button assembly of a dishwasher according to the present invention will be described in detail with reference to the accompanying drawings. While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

FIG. 1 is a sectional view of a condenser-type laundry dryer employing a lint filter assembly according to the present invention, and FIG. 2 is a perspective view of the condenser-type laundry dryer.

Referring to FIGS. 1 and 2, the laundry dryer 100 according to the present invention includes: a cabinet 130 forming the exterior of the dryer, a top cover 131 covering the top of the cabinet 130, a front cover 120 installed at the front of the cabinet 130, a door 110 installed to open and close through an opening of the front cover 120, a control panel 150 installed at the top of the front cover 120 and housing electronics in its rear portion for controlling the dryer, and a drawer 140 disposed next to the control panel 150 to be inserted into the dryer for holding condensed water.

In further detail, the control panel 150 has a dial knob 151 and setting buttons 154 for entering operation settings, a display 152 for showing the operation status of the dryer, an on/off button 153 for applying electrical current to the dryer 100, and a start button 155 to begin a drying cycle.

Also, the dryer 100 includes: a door lint filter 200 disposed at the rear of the door 110 for filtering lint, a drying drum 160 located inside the cabinet 130 for receiving laundry, a motor 103 for driving the drying drum 160, a motor shaft 104 passing through the center of the motor 103, and a belt 161 wrapped around the outer perimeter of the motor shaft 104 and the drying drum 160 for transmitting the rotational force of the motor 103 to the drying drum 160. In further detail, the door lint filter 200 is made up of a filter housing 220 fixed to the rear of the door 110 and a filter main body 210 that can be removably inserted into the filter housing 220. A detailed description of the door lint filter 200 will later be given, with reference to the drawings.

Additionally, the dryer 100 includes: a base 101 disposed below the drying drum 160 and having the motor 103 installed on its upper surface, a cooling fan 102 installed inside the base 101 for suctioning air from the outside, a drying duct 105 installed at the rear of the cabinet 130 for circulating the air inside the drying drum 160 to the inside of the dryer 100, a drying fan 107 installed inside the drying duct 105 for suctioning air inside the drying drum 160, and a heater 106 installed inside the drying duct 105 for heating air suctioned by the drying fan 107. Furthermore, the cooling fan 102 and the drying fan 107 are connected to the motor shaft 104, and installed at mutually opposed ends.

In more detail, the base 101 has a built-in air passage, above which the cooling fan 102 is installed. Below the front cover 120 is an intake grill 180 for drawing in air from the outside. At the end of the air passage is a condenser (not shown) for causing the air passing through the drying drum 160 and the air suctioned through the air passage inside the base 101 to exchange heat. The condenser is inserted into the base 101 by opening a cover 170 formed at the lower front portion of the front cover 120 and being inserted therethrough.

Furthermore, an opening 121 is formed in roughly the center of the front cover 120 for inserting the door lint filter 200 therein and a body lint filter 190 into the lower edge of the opening 121. At the upper portion of the base 101 is formed a circulation duct 192 for circulating the air that passes through the body lint filter 190 through to the condenser.

The following is a description of the dryer 100 operation according to the present invention.

First, a user opens the door 110 and puts wet laundry into the drum 160. Then the user presses the on/off button 153 on the front panel 150 to send electricity to the dryer 100. Next, using the dial knob 151 and setting buttons 155, the user inputs the desired operation settings, and presses the start button 155 to activate the dryer 100.

In more detail, when the dryer 100 is activated, the motor 103 and heater 106 receive electricity and begin operation. When the motor 103 operates, the motor shaft 104 turns, thereby turning the belt 161 and consequently, the drying drum 160.

Moreover, at the same time the motor 104 rotates, the cooling fan 102 and drying fan 107 spin simultaneously. As the drying fan 107 spins, the air (A) inside the drying drum 160 is suctioned and exhausted through to the drying duct 105. The air that flows into the drying duct 105 is heated by the heater 106, and re-enters the drying drum 160. The air that re-enters the drying drum 160 absorbs moisture retained in the laundry, and becomes humid air.

The hot air that has become humid in the drying drum 160 passes through the door lint filter 200, shedding its airborne lint and foreign substances. The air (A) that passes through the door lint filter 200 then passes through the body lint filter 190 in a second filtering stage, and then moves along the circulation duct 192. Then, the air passes through the condenser installed in the circulation duct 192.

Next, as the cooling fan 102 spins, outside air (B) is suctioned through the intake grill 180. The suctioned air (B) then passes through the condenser. Here, the outside air (B) that passes through the condenser and the air (A) that moves along the circulation duct mutually exchange heat. The outside air (B) and the air (A) moving along the circulation duct do not mix, and only exchange heat. The outside air that passes through the condenser is exhausted to the outside again, and the circulating air moves along the circulation duct inside the base 101 towards the drying fan 107. That is, the air (A) inside the drying drum is continuously recirculated through the drying drum.

FIG. 3 is rear view of the door lint filter according to the present invention.

Referring to FIG. 3, the door lint filter 200 according to the present invention has, as described, a filter housing 220 and a filter main body 210 that inserts perpendicularly into the filter housing 220. Here, the inserting direction of the filter main body 210 is not limited to the embodiments of the present invention, and can be inserted sideways or in any number of other ways.

In further detail, the filter housing 220 has a seal 221 formed along the peripheral edge of the opening meeting the rear of the door 110. Accordingly the air that enters the filter housing 220 from inside the drum cannot escape out of the dryer 100.

Also, at the rear of the filter housing 220 is a plurality of perforations 224 for allowing air from the drum into the filter housing 220.

For our purposes, the front of the filter housing 220 is the facet attached to the opening at the rear of the door 110, and the rear of the filter housing 220 is the facet facing the inside of the drying drum 160.

The filter main body 210 inserted in the filter housing 220 includes a wire mesh 211, a frame 212 formed around the periphery of the wire mesh 211 for protecting the same, and a handle 213 disposed at the top of the frame 212 for a user to grasp when inserting or pulling out the filter main body 210. Also, a guide rail 222 is disposed on either side of the filter housing 220 for guiding the filter main body 210 so that the latter can easily slide in and out of the filter housing 220.

The filter housing 220 is completely sealed on the rear of the door 110. The seal 221 around the periphery of the filter housing 220 prevents leakage therethrough. As illustrated, the filter housing 220 has a U-shaped cross section, and allows a pre-determined space between it and the opening wall when the door 110 is closed. A user grasps the handle 212 formed at the top of the filter main body 210 to insert the latter into the filter housing 220.

FIG. 4 is a frontal perspective view of the door lint filter according to the present invention.

Referring to FIG. 4, the filter housing 220 of the door lint filter 200 according to the present invention has an exhaust duct 223 formed at its bottom, to allow air passing through the filter main body 210 to pass into the body lint filter 190.

Also, a securing member 230 protrudes perpendicularly to the guide rail 222 at the bottom end of the guide rail 222 for guiding an inserted filter main body. The securing member 230 protrudes towards the rear of the filter housing 220.

In further detail, the securing member 230 pushes each lower end of the periphery of the filter main body 210, so that the filter main body 210 is pressed completely against the rear of the filter housing 220. In other words, the securing member 230, as previously described, is formed to extend a predetermined distance at a right angle from the guide rail 222, so that the rear periphery of the filter main body 210 comes into contact with the securing member 230.

In still further detail, the securing member 230 is formed in a roughly rectangular shape, with a convexing portion 232 convexing outward from the center of the end portion of the securing member 230. The securing member 230 also includes a supporting protrusion 231 for supporting the convexing portion 232.

The following is an explanation of the workings of the securing member 230.

First, when a user inserts the filter main body 210 perpendicularly downward, the lower periphery of the filter main body 210 contacts the convexing portion 232 of the securing member 230. Next, the lower periphery of the filter main body 210 is pressed against the rear of the filter housing 220 by the securing member 230. Consequently, the filter main body 210 and the rear of the filter housing 220 are firmly sealed.

Here, as the filter main body 210 is pressed against the rear of the filter housing 220, the convexing portion 232 is pressed towards the supporting protrusion 231. However, the convexing portion 232 is pressed only as far as the space between it and the supporting protrusion 231. When the user pulls the filter main body 210 from the filter housing 220, the convexing portion 232 returns to its original shape, due to its inherent elasticity. That is, the contact between the supporting protrusion 231 and the convexing portion is 232 broken.

As shown in the preceding explanation, the filter main body 210 is pressed more firmly against the rear of the filter housing 220, thus preventing hot moist air that passes into the filter housing 220 from not passing through the filter main body 210, but leaking through gaps instead. The hot air passes from the front of the drying drum 160 through perforations 224 formed at the rear of the filter housing 220 to the inside of the filter housing 220. When the air passes through the wire mesh 211 of the filter main body 210, lint and other impurities are removed. The air that passes through the wire mesh 211 passes through the exhaust duct 223 formed at the bottom of the filter housing 220 (as shown) towards the body lint filter 190.

INDUSTRIAL APPLICABILITY

Because the lint filter assembly for a laundry dryer according to the present invention completely filters the lint inside the drying drum during a drying cycle, air outside the dryer will not be polluted by the air from the dryer and the dryer will not suffer electrical or mechanical failures caused by lint build-up on its components, thereby providing a high industrial applicability of the present invention.

The invention claimed is:

1. A lint filter assembly for a dryer comprising:

a door;

a lint filter including a filter housing installed at a rear of the door and a filter main body inserted into the filter housing; and at least one securing member for securing the filter main body to the filter housing;

a convex portion formed at the securing member and configured to contact the filter; and a supporting protrusion spaced away from the convex portion, wherein the filter main body is inserted into the filter housing, the convex portion is convex towards the supporting protrusion to be supported by the supporting protrusion.

2. The lint filter assembly according to claim 1, wherein the filter housing has a guide rail formed therein for guiding the filter main body therein.

3. The lint filter assembly according to claim 2, wherein the securing member is formed at a bottom portion of the guide rail.

4. The lint filter assembly according to claim 2, wherein the securing member is formed perpendicularly to the guide rail.

5. The lint filter assembly according to claim 1, wherein the convex portion has a predetermined elasticity.

6. The lint filter assembly according to claim 1, wherein the filter main body is pressed firmly by the securing member against a rear of the filter housing.

7. The lint filter assembly according to claim 1, wherein the convex portion has a deformation degree limited by the supporting protrusion.

8. The lint filter assembly according to claim 1, wherein the filter main body inserts into the filter housing from a top or a side.

9. The lint filter assembly according to claim 1, wherein the pressing member protrudes in a direction so that the pressing member presses the filter main body against a rear of the filter housing.

* * * * *